US011214063B2

(12) United States Patent
Katayama et al.

(10) Patent No.: US 11,214,063 B2
(45) Date of Patent: Jan. 4, 2022

(54) LIQUID DISCHARGE HEAD

(71) Applicant: BROTHER KOGYO KABUSHIKI KAISHA, Nagoya (JP)

(72) Inventors: Hiroshi Katayama, Toyoake (JP); Jiro Yamamoto, Nagoya (JP); Keita Sugiura, Toyokawa (JP); Shotaro Kanzaki, Handa (JP); Taisuke Mizuno, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/070,315

(22) Filed: Oct. 14, 2020

(65) Prior Publication Data

US 2021/0170747 A1 Jun. 10, 2021

(30) Foreign Application Priority Data

Dec. 4, 2019 (JP) ..... JP2019-219737

(51) Int. Cl.
*B41J 2/14* (2006.01)

(52) U.S. Cl.
CPC ..... *B41J 2/1433* (2013.01)

(58) Field of Classification Search
CPC ..... B41J 2/1433; B41J 2002/14225; B41J 2002/14419; B41J 2002/14459; B41J 2202/12; B41J 2202/11; B41J 2/14209
See application file for complete search history.

(56) References Cited

U.S. PATENT DOCUMENTS

2017/0096015 A1* 4/2017 Odaka ..... B41J 2/17509

FOREIGN PATENT DOCUMENTS

JP 2017-65249 A 4/2017

* cited by examiner

*Primary Examiner* — Bradley W Thies
(74) *Attorney, Agent, or Firm* — Merchant & Gould P.C.

(57) ABSTRACT

There is provided a liquid discharge head including: first and second common channels extending in a first direction; and a plurality of individual channels each including: a supplying part, a descender part, and a returning part. The returning part includes: a throttle part and a wide part. Each of a plurality of nozzles is located at a position at which each of the plurality of nozzles overlaps with the wide part in a second direction. At a throttle-starting position which is a boundary between the throttle part and the wide part, a length in the second direction of the throttle part and a length in the second direction of the wide part are same.

11 Claims, 6 Drawing Sheets

LIQUID DISCHARGE HEAD

CROSS REFERENCE TO RELATED APPLICATION

The present application claims priority from Japanese Patent Application No. 2019-219737, filed on Dec. 4, 2019, the disclosure of which is incorporated herein by reference in its entirety.

BACKGROUND

Field of the Invention

The present disclosure relates to a liquid discharge head which discharges a liquid, such as an ink, toward a medium.

Description of the Related Art

An ink-jet head of a circulation type is known as the liquid discharge head which discharges a liquid. For example, in a publicly-known ink-jet head, an ink flowing out of a common liquid chamber passes through an individual liquid chamber (pressure chamber) and a nozzle passage (descender channel), and is discharged or ejected from a nozzle. On the other hand, the ink which is not discharged from the nozzle passes through a discharge channel and flows into a circulating common liquid chamber. In such a manner, a flow of the ink (ink flow) is generated at a location near to the nozzle to thereby prevent the ink from drying in the vicinity of the nozzle.

In the ink-jet head, the discharge channel has a circulating liquid chamber which is connected to the nozzle passage extending in an up-down direction and which extends in a horizontal direction, and a fluid-resisting part which has channel cross-sectional area smaller than that of the circulating liquid chamber.

SUMMARY

It is known that the ink-jet head of the circulation type not only prevents the ink in the vicinity of the nozzle from drying, but also that, in such a case that any air enters from the nozzle, the ink-jet head is capable of removing the air by using the ink flow. The inventors of the present disclosure found out, as a result of diligent and intensive studies and considerations, that in the above-described ink-jet head, a stepped part in a height direction (difference in height) is formed at the boundary between the circulating liquid chamber and the fluid-resisting part, and thus there is such a possibility that the air might be caught by the stepped part, and thus might become hard to be exhausted or discharged, and the inventors arrived at the present disclosure.

An object of the present disclosure is to provide a liquid discharge head of the circulation type wherein air entered thereinto from a nozzle is easily exhausted or discharged by a flow of ink in the vicinity of the nozzle.

According to an aspect of the present disclosure, there is provided a liquid discharge head including: a first common channel extending in a first direction; a second common channel extending in the first direction; and a plurality of individual channels having a plurality of pressure chambers arranged side by side in the first direction and a plurality of nozzles arranged side by side in the first direction. Each of the plurality of individual channels includes: a supplying part which communicates the first common channel with one of the plurality of pressure chambers; a descender part which extends in a second direction crossing the first direction and which communicates one of the plurality of pressure chambers located on an upstream side in the second direction with one of the plurality of nozzles located on a downstream side in the second direction; and a returning part which branches from the descender part, which extends in a third direction crossing the first direction and the second direction and which communicates with the second common channel. The returning part of each of the plurality of individual channels includes: a throttle part, a downstream end in the third direction of the throttle part being connected to the second common channel; and a wide part, an upstream end in the third direction of the wide part being connected to the descender part, a downstream end in the third direction of the wide part being connected to an upstream end in the third direction of the throttle part, and a cross-sectional area of a surface, of the wide part, which is perpendicular to the third direction is greater than a cross-sectional area of a surface, of the throttle part, which is perpendicular to the third direction. Each of the plurality of nozzles is located at a position at which each of the plurality of nozzles overlaps with the wide part in the second direction. At a throttle-starting position which is a boundary between the throttle part and the wide part, a length in the second direction of the throttle part and a length in the second direction of the wide part are same.

In the above-described configuration, at the throttle-starting position which is the boundary between the throttle part and the wide part, the length in the second direction of the throttle part and the length in the second direction of the wide part are same. That is, at the throttle-starting position, the height of the throttle part and the height of the wide part are same. Therefore, any stepped part in the height direction does not occur between the throttle part and the wide part at the throttle-stating position. As a result, when the ink flows from the wide part to the throttle part, it is possible to suppress such a situation that any air contained in the ink is caught by the stepped part, and it is possible to efficiently remove the air.

DESCRIPTION OF THE EMBODIMENTS

<Overall Configuration of Printer>

Figure 1:
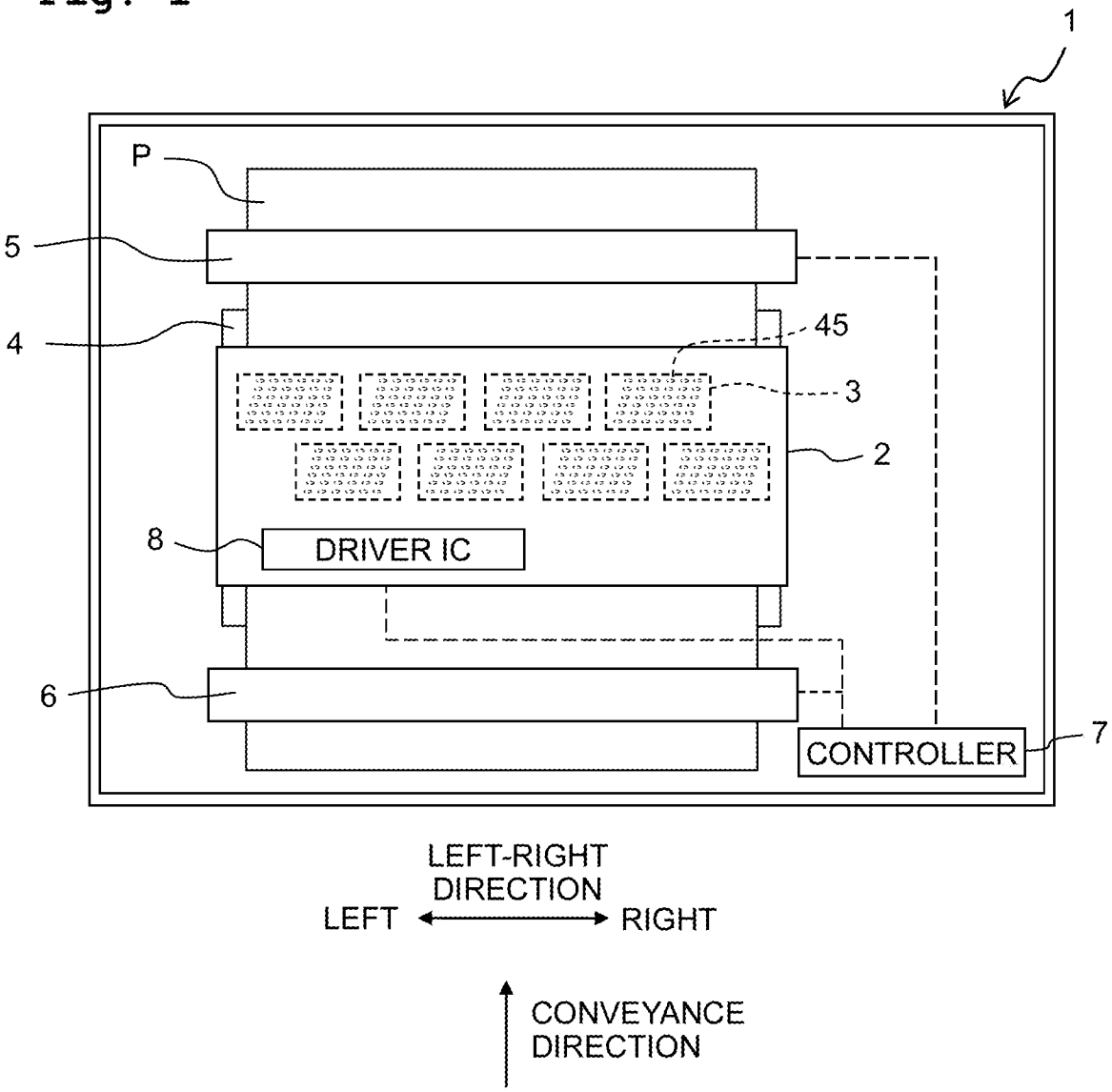
FIG. 1 is a plan view schematically depicting an ink-jet printer.

As depicted in FIG. 1, a printer 1 according to an embodiment of the present disclosure mainly includes an ink-jet head 2, a head unit 3, a platen 4, conveying rollers 5 and 6, and a controller 7. In the following, a direction in which a recording paper (recording paper sheet, recording sheet) P is conveyed is defined as a conveyance direction, and the upstream side and the downstream side in the conveyance direction are defined, as depicted in FIG. 1. Further, a paper width direction of the recording paper P which is conveyed is defined as a left-right direction, and the right side and the left side of the left-right direction are also defined. The conveyance direction and the left-right direction are each a direction parallel to a horizontal plane and are orthogonal to each other.

The ink-jet head 2 is an ink-jet head of a so-called line-type, and has eight pieces of the head unit 3. Further, as will be described later on, the ink-jet head 2 is an ink-jet head of a circulation type. As depicted in FIG. 1, the eight head units 3 are arranged in the staggered manner in the conveyance direction and the left-right direction. Each of the eight head units 3 discharges or ejects an ink from a plurality of nozzles 45 formed in the lower surface thereof. The ink-jet head 2 is provided with a driver IC 8. As will be described later, the controller 7 controls the driver IC 8 so as to discharge or eject an ink from a desired nozzle 45 among the plurality of nozzles 45.

The platen 4 is arranged so as to face or to be opposite to the lower surface of the ink-jet head 2. The platen 4 extends in the left-right direction over the entire length in the paper width direction of the recording paper P. The platens 4 supports the recording paper P from therebelow. The conveying rollers 5 and 6 are arranged at the upstream side and the downstream side, respectively, in the conveyance direction of the recording paper P, and convey the recording paper P in the conveyance direction.

In the printer 1, the controller 7 controls a non-illustrated motor (not depicted in the drawings) provided on the conveying rollers 5 and 6 so as to cause the conveying rollers 5 and 6 to convey the recording paper P in the conveyance direction by a predetermined distance. The controller 7 discharges or ejects the ink from the plurality of nozzles 45 of the ink-jet head 2 each time the recording paper P is conveyed. With this, the printer 1 executes printing with respect to the recording paper P.

<Head Unit 3>

Figure 2:
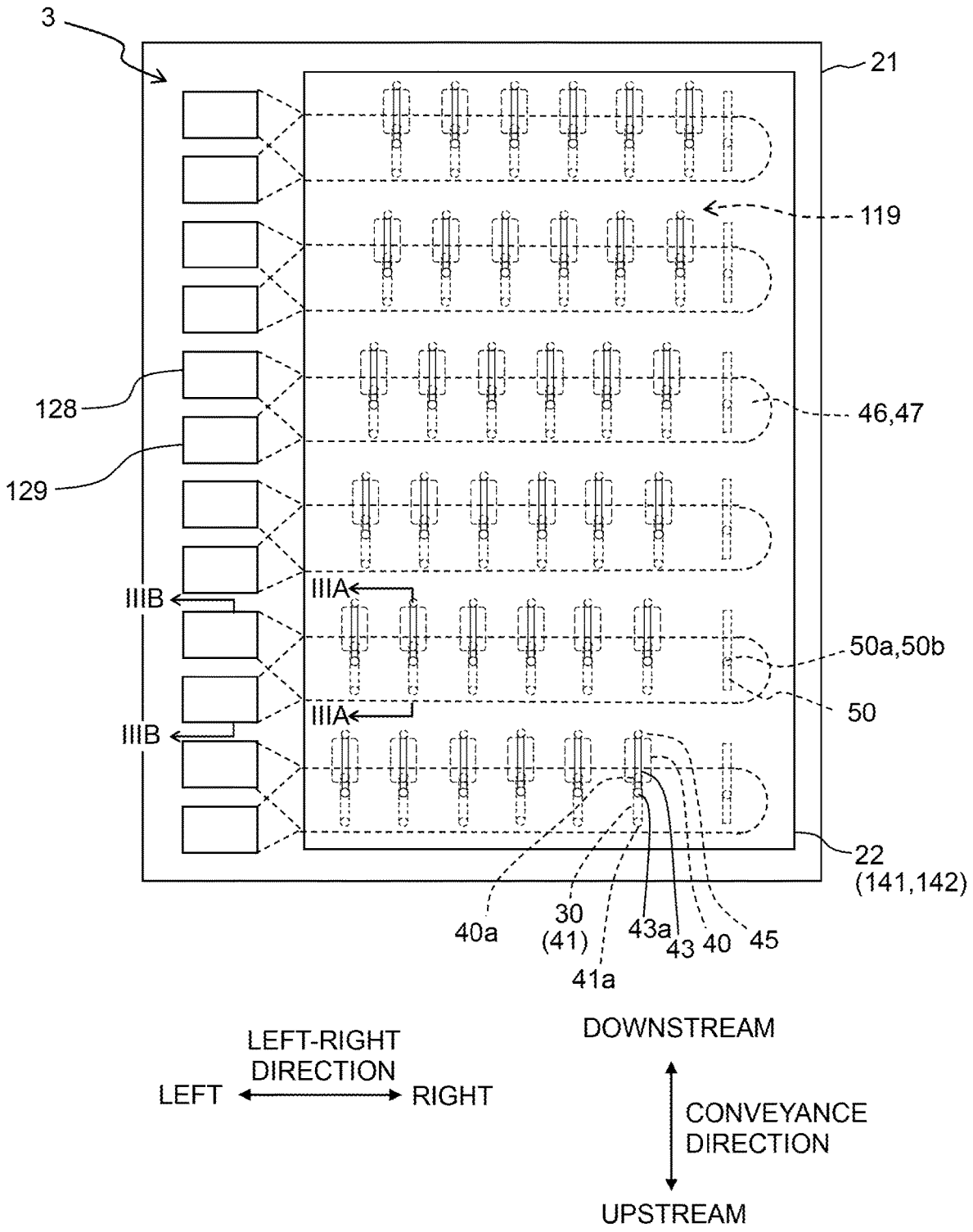
FIG. 2 is a plan view of an ink-jet head.
Figure 3A:
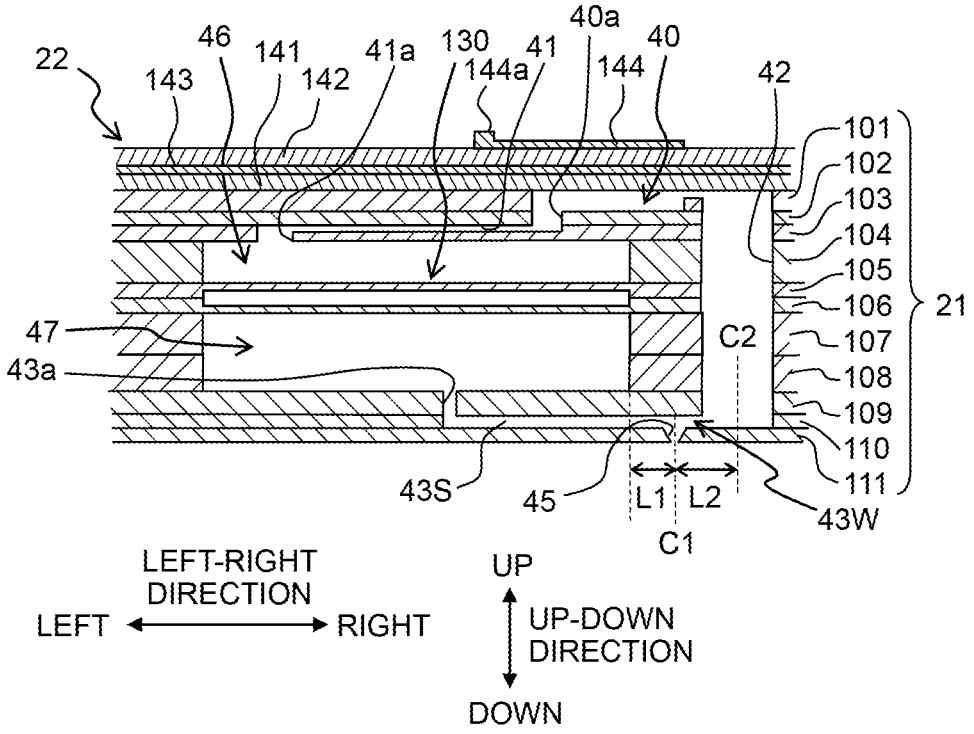
FIGS. 3A and 3B are each a cross-sectional view schematically depicting an ink-jet head according to a first embodiment.

Next, the head unit 3 of the ink-jet head 2 will be explained. As depicted in FIGS. 2 and 3A, each of the eight head units 3 includes a channel unit 21 in which an ink channel such as the plurality of nozzles 45 and a plurality of pressure chambers 40 are formed, and a piezoelectric actuator 22 which applies pressure to the ink in each of the plurality of pressure chambers 40.

<Flow Channel Unit 21>

Figure 3B:
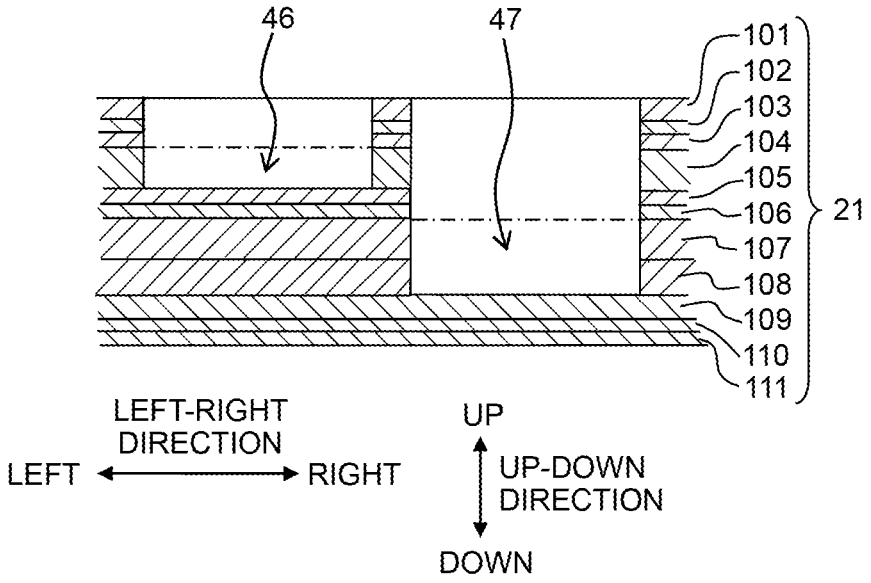

As depicted in FIGS. 3A and 3B, the channel unit 21 has eleven plates 101 to 111 which are stacked on one another in the up-down direction. The up-down direction corresponds to a "second direction" of the present disclosure. As depicted in FIG. 2, the channel unit 21 has six supply manifolds 46, six return manifolds 47, a plurality of individual channels 30, and the plurality of pressure chambers 40 and the plurality of nozzles 45 formed in the plurality of individual channels 30. The plurality of individual channels 30 have supplying parts 41, descender parts 42 (see FIG. 3A), and returning parts 43, respectively. Note that, for a purpose that the drawings are seen comprehensively, the returning parts 43 in FIG. 2 are illustrated by a solid line.

The plurality of pressure chambers 40 are formed in the plate 101. Each of the plurality of pressure chambers 40 has a substantially rectangular shape of which longitudinal direction is the conveyance direction. Further, the plurality of pressure chambers 40 construct six pressure chamber rows (arrays) 119 arranged side by side in the conveyance direction. Each of the six pressure chamber arrays 119 extends in the left-right direction. In two pressure chamber arrays 119, included in the six pressure chamber arrays 119 and which are adjacent to each other, the positions in the left-right direction of the pressure chambers 40 are shifted.

The plurality of supplying parts 41 are formed across the plates 102 and 103. Each of the supplying parts 41 is a channel connecting one of the plurality of pressure chambers 40 and the supply manifold 46 to each other. One end of each of the supplying parts 41 is connected to one of the plurality of pressure chambers 40 through an opening 40*a* formed in an end part on the upstream side in the conveyance direction of one of the plurality of pressure chambers 40. The other end of each of the supplying parts 41 is connected to the supply manifold 46 through a supply port 41*a* (an example of a "supply port" of the present disclosure). The cross-sectional area of each of the supplying parts 41 is smaller than the cross-sectional area of one of the descender parts 42. Each of the supplying parts 41 is connected to an end part on the upstream side in the conveyance direction of one of the plurality of pressure chambers 40, and extends from a connection part with respect to one of the plurality of pressure chambers 40 toward the upstream side in the conveyance direction.

Figure 4A:
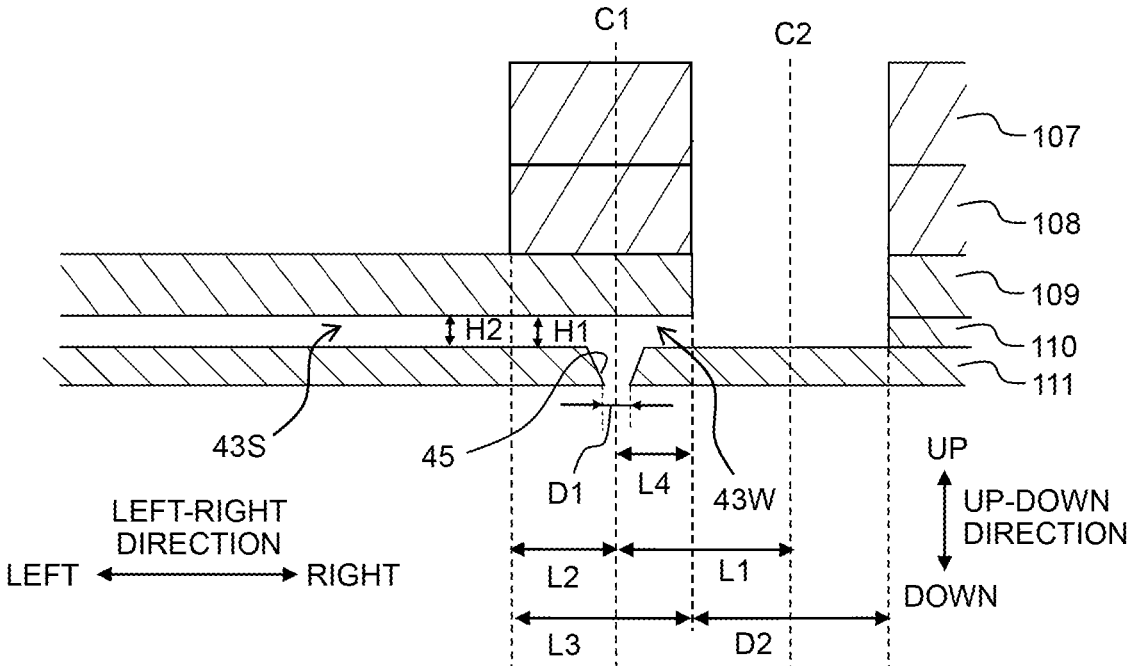
FIG. 4A is a partially enlarged view of FIG. 3A.

The plurality of descender parts 42 are formed by allowing through holes formed in the plates 102 to 110, respectively, to overlap with one another in the up-down direction. Each of the descender parts 42 is a part of a channel connecting one of the plurality of pressure chambers 40 and one of the plurality of nozzles 45 and extending downward from an end part on the downstream side in the conveyance direction of one of the plurality of pressure chambers 40. A lower end of each of the descender parts 42 is connected to one of the returning parts 43 extending in the conveyance direction. Each of the descender parts 42 is a channel having a substantially cylindrical shape extending in the up-down direction. As depicted in FIG. 4A, an inner diameter D2 of each of the descender parts 42 is greater than a distance L3 in the conveyance direction from a throttle starting position P1 (to be described later on) to the boundary between a wide part 43W and a throttle part 43S (to be described later on) (L3<D2). In the present embodiment, the distance L3 in the conveyance direction from the throttle starting position P1 to the boundary between the wide part 43W and the throttle part 43S is in a range of approximately 30 μm to approximately 150 μm, and the inner diameter D2 of the descender part 42 is in a range of approximately 150 μm to approximately 180 μm.

The plurality of returning parts 43 are formed in the plates 109 and 110. Each of the plurality of returning parts 43 is a channel connecting one of the descender parts 42 and the return manifold 47. Each of the returning parts 43 extends toward the upstream side in the conveyance direction from a connecting part with respect to one of the descender parts 42 formed in the plate 110. Further, each of the returning parts 43 is connected to the return manifold 47 through a return port 43*a* (an example of a "return port" of the present disclosure) formed in the plate 109. Each of the returning parts 43 includes a wide part 43W and a throttle part 43S. A length H1 in the up-down direction (hereinafter also referred to as height H1) of the wide part 43W is the same as a height H2 of the throttle part 43S (see FIG. 4A). In the present embodiment, the height H1 of the wide part 43W and the height H2 of the throttle part 43S are approximately 15 μm.

As depicted in FIGS. 3A and 4A, each of the plurality of nozzles 45 is formed in the plate 111, at a position overlapping with the wide part 43W in the up-down direction. As depicted in FIG. 4A, a distance L2 in the conveyance direction from the boundary between the wide part 43W and the throttle part 43S to a center line C1 of each of the plurality of nozzles 45 is shorter than a distance L1 in the conveyance direction from the center line C1 of each of the plurality of nozzles 45 to a center line C2 of the descender part 42 (L2<L1). In the present embodiment, the distance L1 is set to be approximately two times the distance L2. Note that in the following explanation, the boundary between the wide part 43W and the descender part 42 (or "the throttle part 43S") is referred to as a throttle starting position P1 (see FIG. 4B). A distance L3 in the conveyance direction from the throttle starting position P1 to the boundary between the wide part 43W and the descender part 42 is greater than an inner diameter D1 of each of the plurality of nozzles 45 (D1<L3). Further, a distance L4 from the boundary between the wide part 43W and the descender part 42 to the center line C1 of each of the plurality of nozzles 45 is shorter than the distance L2 in the conveyance direction from the throttle starting position P1 to the center line C1 of each of the plurality of nozzles 45 (L4<L2). In the present embodiment, the distance L1 in the conveyance direction from the center line C1 of each of the plurality of nozzles 45 to the center line C2 of the descender part 42 is set to be two times the distance L2 in the conveyance direction from the throttle starting position P1 to the center line C1 of each of the plurality of nozzles 45. Further, the inner diameter D1 of each of the plurality of nozzles 45 is defined as the diameter of an opening of the lower surface of the plate 111. In the present embodiment, the inner diameter D1 of each of the plurality of nozzles 45 is approximately 17 μm. As described above, there is no stepped part in the up-down direction (difference in height) at the boundary between the wide part 43W and the throttle 43S (H1−H2=0). Further, the distance L2 in the conveyance direction from the throttle starting position P1 to the center line C1 of each of the plurality of nozzles 45 is in a range of 70 μm to 80 μm, the distance L1 in the conveyance direction from the center line C1 of each of the plurality of nozzles 45 to the center line C2 of the descender part 42 is in a range of 120 μm to 130 μm, and the distance L4 in the conveyance direction from the boundary between the wide part 43W and the descender part 42 to the center line C1 of each of the plurality of nozzles 45 is in a range of 10 μm to 20 μm.

Figure 4B:
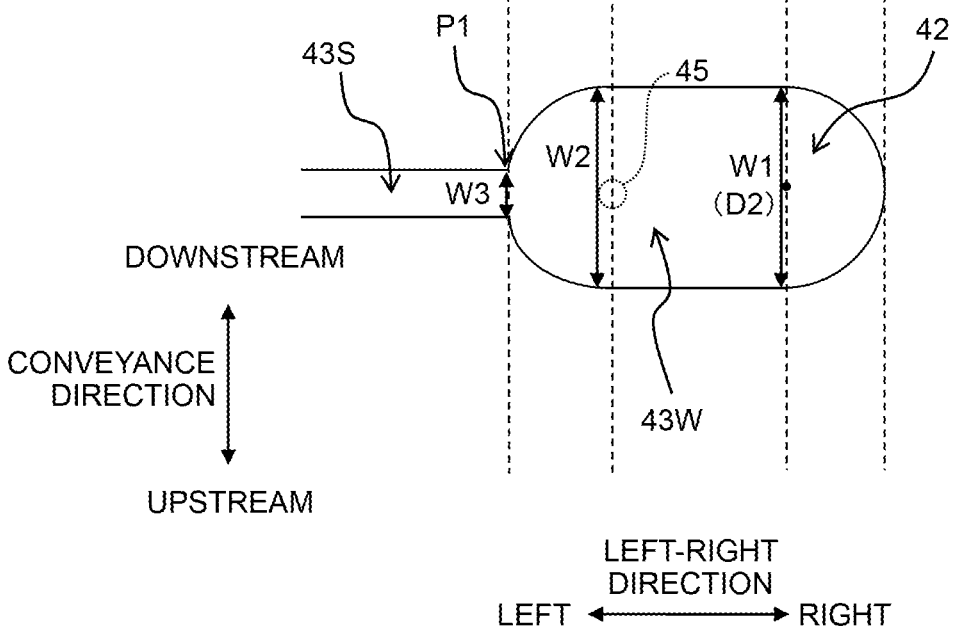
FIG. 4B is a top view of FIG. 4A.

As depicted in FIG. 4B, the descender part 42 and the wide part 43 have an oval shape in a top view. The length W1 in the conveyance direction of the descender part 42 is the same as the length W2 in the conveyance direction of the wide part 43W (W1=W2). Further, both ends in the conveyance direction in an end part, of the wide part 43, which is on a side closer to the throttle part 43S in the left-right direction have a chamfered shape which is a curved shape in a top view. In the present embodiment, the both ends in the conveyance direction in the end part, of the wide part 43, which is on the side closer to the throttle part 43S in the left-right direction have a shape which is substantially elliptical in a top view. A length W3 in the conveyance direction of the throttle part 43S at the throttle starting position P1 is smaller than the length W2 in the conveyance direction of the wide part 43W (W3<W2). In the present embodiment, the length W3 in the conveyance direction of the throttle part 43S at the throttle starting position P1 is not more than half the length W2 in the conveyance direction of the wide part 43W (W3≤(W2)/2). In the present embodiment, the length W1 in the conveyance direction of the descender part 42 and the length W2 in the conveyance direction of the wide part 43W are in a range of approximately 150 μm to approximately 180 μm, and the length W3 in the conveyance direction of the throttle part 43S at the throttle-stating position P1 is in a range of approximately 70 μm to approximately 100 μm.

As depicted in FIG. 3A, the supply manifold 46 is formed in plate 104. As depicted in FIG. 2, each of the six supply manifolds 46 extends in the left-right direction, and the six supply manifolds 46 are arranged side by side, with spacing distances therebetween, in the conveyance direction. The six supply manifolds 46 correspond to the six pressure chamber arrays 119, and each of the respective supply manifolds 46 is connected, via the supplying parts 41, to pressure chambers 40, respectively, constructing a pressure chamber array 119, among the six pressure chamber arrays 119, corresponding thereto. Supply ports 128 are formed each at an end part on the left side in the left-right direction of one of the six supply manifolds 46. Further, the ink stored in a non-illustrated ink tank is supplied from the supply ports 128 to the six supply manifolds 46, respectively. With this, in each of the six supply manifolds 46, the ink flows from the left side to the right side in the left-right direction, and the ink is supplied to each of the pressure chambers 40 through one of the supplying parts 41.

As depicted in FIG. 3A, the return manifold 47 is formed in plates 107 and 108. As depicted in FIG. 2, each of the six return manifolds 47 extends in the left-right direction, and the six return manifolds 47 are arranged side by side, with spacing distances therebetween, in the conveyance direction. Recovery ports 129 are formed each at an end part on the left side in the left-right direction of one of the six return manifolds 47. The non-illustrated ink tank is connected to the recovery ports 129. As depicted in FIGS. 3A and 3B, each of the return manifolds 47 is located at a location below one of the supply manifolds 46 and overlaps one of the supply manifolds 46 in the up-down direction. Further, the six return manifolds 47 correspond to the six pressure chamber arrays 119, respectively, and each of the return manifolds 47 is connected to the pressure chambers 40 constructing a pressure chamber array 119, among the six pressure chamber arrays 119 and corresponding thereto, via the descender parts 42 and the returning parts 43. In each of the return manifolds 47, the ink which is not discharged or ejected from one of the nozzles 45 flows thereinto from the returning part 43 of one the individual channels 30; the ink flows from the right side toward the left side in the left-right direction; and the ink is recovered from one of the recovery ports 129. The ink flowing out from the recovery ports 129 is returned to the non-illustrated ink tank.

Note that as depicted in FIG. 2, communicating channels 50 connecting the supply manifolds 46 and the return manifolds 47, respectively, are formed at right ends in the left-right direction of the supply manifolds 46 and the return manifolds 47, respectively. Since each of the communicating channels 50 has a same shape as one of the plurality of individual channels 30 except that each of the communicating channels 50 is not in communication with one of the plurality of nozzles 45, a detailed description thereof will be omitted.

In the present embodiment, a non-illustrated pump is provided at an intermediate part or location in a channel between the ink supply ports 128 and the ink tank, or at an intermediate part or location in a channel between the recovery ports 129 and the ink tank. The ink is circulated between the ink-jet head 2 and the non-illustrated ink tank by a flow of ink generated in a case that the non-illustrated pump is driven. Note that in the present embodiment, the pressure applied to the ink flowing through each of the supply manifolds 46 is made to be greater than the pressure applied to the ink flowing through each of the return manifolds 47. This creates a flow of the ink from each of the supply manifolds 46 to one of the return manifolds 47.

Further, in the channel unit 21, a damper 130 is formed. The damper 130 extends across a lower part of the plate 105 and an upper part of the plate 106, and overlaps with each of the supply manifolds 46 and each of the return manifolds 47 in the up-down direction. Further, in a case that a partition wall separating each of the supply manifold 46 and the damper 130 and formed by a lower end part of the plate 106 is deformed, any pressure fluctuation of the ink in each of the supply manifolds 46 is suppressed. Furthermore, in a case that a partition wall separating each of the return manifold 47 and the damper 130 and formed by an upper end part of the plate 105 is deformed, any pressure fluctuation of the ink in each of the return manifolds 47 is suppressed.

<Piezoelectric Actuator>

As depicted in FIG. 3A, the piezoelectric actuator 22 has two piezoelectric layers 141 and 142, a common electrode 143, and a plurality of individual electrodes 144. The piezoelectric layers 141 and 142 are formed of a piezoelectric material. For example, it is possible to use a piezoelectric material containing, as a main component thereof, lead zirconate titanate (PZT) which is a mixed crystal of lead titanate and lead zirconate. The piezoelectric layer 141 is arranged on the upper surface of the channel unit 21, and the piezoelectric layer 142 is arranged on the upper surface of the piezoelectric layer 141. Note that the piezoelectric layer 141 may be formed of an insulative material which is different from the piezoelectric material.

The common electrode 143 is arranged between the piezoelectric layer 141 and the piezoelectric layer 142 and extends continuously over the entire areas of the piezoelectric layers 141, 142. The common electrode 143 is maintained at the ground potential. The plurality of individual electrodes 144 are provided individually with respect to the plurality of pressure chambers 40, respectively. Each of the plurality of individual electrodes 144 has a planar shape which is substantially rectangular, and is arranged so as to overlap, in the up-down direction, with a central part of one of the plurality of pressure chambers 40 corresponding thereto. Connection terminals 144*a* of the plurality of individual electrodes 144 are connected to the driver IC 8 (see FIG. 1) via non-illustrated trace members. The individual electrodes 144 are selectively provided with either one potential of the ground potential and the driving potential individually by the driver IC 8. Further, corresponding to the arrangement of the common electrode 143 and the plurality of individual electrodes 144 in such a manner, a part, of the piezoelectric layer 142, which is sandwiched by each of the plurality of individual electrodes 144 and the common electrode 143 is made to be an active part polarized in a thickness direction thereof.

Here, a method of discharging the ink from each of the plurality of nozzles 45 by driving the piezoelectric actuator 22 will be explained. In the present embodiment, the ink(s) is (are) discharged by a so-called pull-strike system as explained below. The control described as below is executed by the controller 7 (see FIG. 1) controlling the driver IC 8, to thereby control the potentials of the common electrode 143 and each of the plurality of individual electrodes 144. In the piezoelectric actuator 22, in a stand-by state in which the ink is not discharged from the nozzle 45, the common electrode 143 is maintained at the ground potential, and all the plurality of individual electrodes 144 are held at driving potential different from the ground potential. In this situation, parts, of the piezoelectric layer 141 and 142, respectively, which overlap with the pressure chamber 40 in the up-down direction are deformed so as to project toward the pressure chamber 40 as a whole.

In a case that the ink is to be ejected or discharged from a certain nozzle 45 among the plurality of nozzles 45, the potential of a certain individual electrode 144 which is included in the plurality of individual electrodes 144 and which corresponds to the certain nozzle 45 is switched to the ground potential. This causes the deformation of the parts, of the piezoelectric layers 141 and 142, overlapping with a certain pressure chamber 40, included in the plurality of pressure chambers 40 and corresponding to the certain nozzle 45, in the up-down direction to return to their original shapes, thereby increasing the volume of the certain pressure chamber 40. Afterwards, by switching the potential of certain individual electrode 144 again to the driving potential, the parts, of the piezoelectric layers 141, 142, overlapping with the certain pressure chamber 40 in the up-down direction are deformed so as to project toward the certain pressure chamber 40. Thus, the pressure of the ink in the certain pressure chamber 40 is increased, and thus the ink is discharged from the certain nozzle 45 communicating with the certain pressure chamber 40. Even after the ink is ejected from the certain nozzle 45, the potential of the certain individual electrode 144 is maintained at the driving potential.

In the present embodiment, the nozzle 45 is provided on the wide part 43W. In other words, at least a part of the nozzle 45 is arranged at a position overlapping the wide part 43W in the up-down direction. For example, there is such a case, for example, that after the ink is discharged, the meniscus of the ink in the nozzle 45 is vibrated and that any air enters from the nozzle 45, in some cases. In such a case that an air bubble, generated by the air which has entered, is present in the inside of the channel, a part of the pressure applied from the piezoelectric actuator 22 so as to discharge the ink is consequently consumed to shrink the air bubble. In such a situation, there is such a fear that the pressure for discharging the ink might become insufficient, and any discharge failure or unsatisfactory discharge might occur. Therefore, it is preferable to remove the air bubble of the air, which has entered from the nozzle 45, as quickly as possible. In particular, in such a case that the air bubble is present in the vicinity of the nozzle 45, there is a high possibility that any discharge failure or unsatisfactory discharge might occur in the nozzle 45, and thus the air bubble is required to be removed quickly.

The ink-jet head 2 of the present embodiment is the ink-jet head of the so-called circulation type. In the ink-jet head 2 of the present embodiment, the air bubble of the air entering from the nozzle 45 can be pushed away toward the return manifold 47 by the ink flowing through the returning part 43 (the wide part 43W).

In the present embodiment, since the height H1 of the wide part 43W is same as the height H2 of the throttle part 43S, there is no stepped part in the height direction (difference in height), at the throttle starting position P1, between the wide part 43W and the throttle part 43S. Therefore, there is no fear that the air bubble of the air might be caught by and remain in any stepped part (difference in height) at the boundary between the wide part 43W and the throttle part 43S, and it is possible to push the air bubble of the air, by the ink flowing through the returning part 43 (the wide part 43W), reliably toward the return manifold 47.

Further, in the present embodiment, the height H2 of the throttle part 43S is uniform in the longitudinal direction (the left-right direction) of the throttle part 43S, and there is not any stepped part in the up-down direction (difference in height), in the inside of the throttle part 43S, at which that the air bubble of the air might be otherwise caught. Therefore, there is no fear that the air bubble of the air might be caught by and might remain at the stepped part also in the inside of the throttle part 43S.

As described above, the both ends in the conveyance direction in the end part, of the wide part 43, which is on the side closer to the throttle part 43S in the left-right direction have a shape which is substantially elliptical in a top view. The both ends in the conveyance direction in the end part, of the wide part 43, which is on the side closer to the throttle part 43S in the left-right direction have a chamfered shape which is a curved shape in a top view. Thus, there is no such a fear that the air bubble of the air might be caught at the both ends in the conveyance direction in the end part, of the wide part 43, which is on the side closer to the throttle part 43S in the left-right direction. Therefore, the air bubble of the air can be reliably pushed toward the return manifold 47 by the ink flowing through the returning part 43 (the wide part 43W).

In the present embodiment, as described above, the distance L2 in the conveyance direction from the boundary between the wide part 43W and the throttle part 43S (throttle starting position P1) to the center line C1 of the nozzle 45 is shorter than the distance L1 in the conveyance direction from the center line C1 of the nozzle 45 to the center line C2 of the descender part 42 (L2<L1). Namely, the center of the nozzle 45 is located at a position closer to the throttle starting position P1 than the center of the descender part of 42. As depicted in FIG. 4B, the length in the conveyance direction of the wide part 43W is narrowed further as approaching closer, in the left-right direction, toward the throttle part 43S, and thus the flow rate of the ink flowing through the wide part 43W becomes faster as the ink approaches closer to the throttle part 43S. Therefore, the center of the nozzle 45 is arranged at the position closer to the throttle starting position P1 than the center of the descender part 42, thereby making the flow rate of the ink flowing in the vicinity of the nozzle 45 to be greater, and allowing the air bubble of the air to be reliably pushed toward the return manifold 47.

As mentioned above, the length W1 in the conveyance direction of the descender part 42 is same as the length W2 in the conveyance direction of the wide part 43W (W1=W2). Therefore, there is no stepped part (difference in height) in the conveyance direction between the descender part 42 and the wide part 43W, and thus there is no such a fear that the air bubble of the air might be caught by the stepped part. Further, the length W3 in the conveyance direction of the throttle part 43S at the throttle starting position P1 is not more than half the length W2 in the conveyance direction of the wide part 43W (W3≤(W2)/2). Note that in the present embodiment, the height H1 of the wide part 43W and the height H2 of the throttle part 43S are same. Therefore, in such a case that the difference between the length W3 in the conveyance direction of the throttle part 43S at the throttle starting position P1 and the length W2 in the conveyance direction of the wide part 43W is small, most of the pressure wave advancing or proceeding to the wide part 43W escapes through the throttle part 43S. From the viewpoint of improving the discharge force of the ink from the nozzle 45 provided on the wide part 43W, it is preferable to set the length W2 in the conveyance direction of the wide part 43W to be not less than two times the length W3 in the conveyance direction of the throttle part 43S. With this, it is possible to suppress any loss of the discharge force of the ink from the nozzle 45 provided on the wide part 43W.

Further, in such a case that a part of the nozzle 45 is at a position overlapping with the descender part 42 in the top plan view, the ink flowing downward through the descender part 42 imparts the downward pressure to the air bubble of the air entering from the nozzle 45, thereby causing the air bubble of the air to be less likely to flow leftward toward the return manifold 47. On the other hand, in the present embodiment, as described above, the distance L3 in the conveyance direction from the throttle starting position P1 to the boundary between the wide part 43W and the descender part 42 is greater than the inner diameter D1 of the nozzle 45 (D1<L3). Therefore, it is possible to arrange the nozzle 45 so that the entirety of the nozzle 45 overlaps reliably with the wide part 43W in the up-down direction. In the wide part 43W, since a component of the ink flow directed to the left side is greater than a component of the ink flow directed to the lower side, the air bubble of the air entered from the nozzle 45 can be reliably pushed toward the return manifold 47.

The pressure wave generated in the pressure chamber 40 becomes weaker as the pressure wave moves farther from the pressure chamber 40. The wide part 43W is connected, at the downstream side thereof in the conveyance direction, to the descender part 42, having a cross-sectional area greater than that of the wide part 43W, and is connected, at the upstream side thereof in the conveyance direction, to the throttle part 43S, having a cross-sectional area smaller than that of the wide part 43W. In the wide part 43W, the pressure wave is not weakened on the downstream side in the conveyance direction which is close to the pressure chamber 40 and the descender part 42, as compared with the upstream side in the conveyance direction close to the throttle part 43S. In the present embodiment, as described above, the distance L4 from the boundary between the wide part 43W and the descender part 42 to the center line C1 of the nozzle 45 is shorter than the distance L2 from the boundary between the wide part 43W and the throttle part 43S (throttle starting position P1) to the center line C1 of the nozzle 45 (L4<L2). With this, it is possible to prevent the pressure wave at a position immediately above the nozzle 45 from becoming too weak, thereby making it possible to prevent any discharge failure of the ink from the nozzle 45.

<Modifications>

Figure 5:
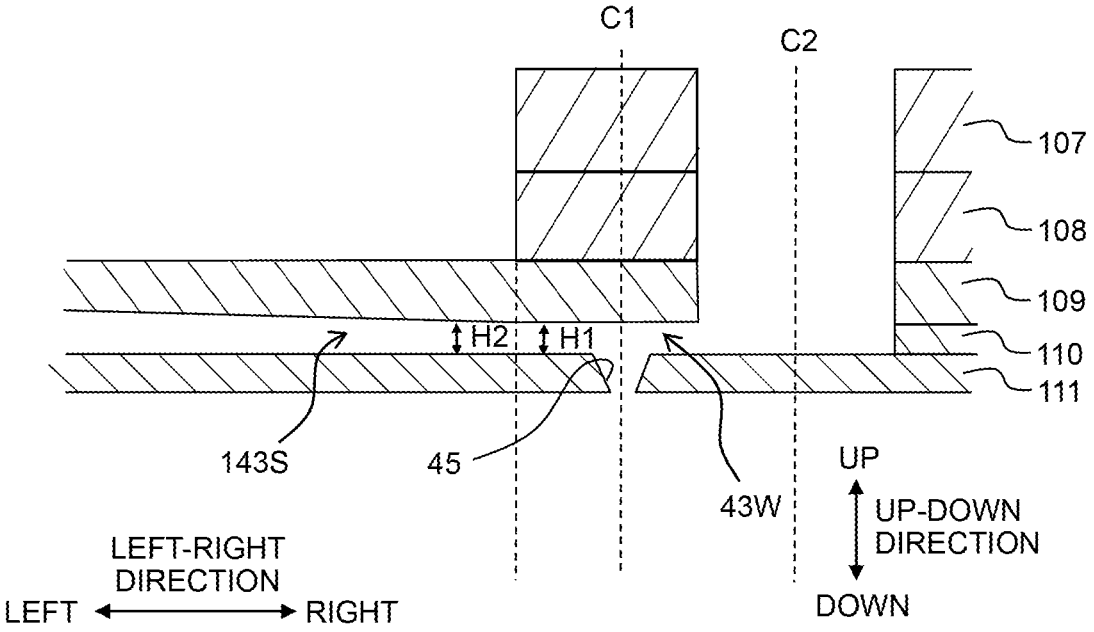
FIG. 5 is a view for explaining a throttle part 143S, and corresponding to FIG. 4A.

The embodiment as explained above is merely an example, and may be changed as appropriate. For example, it is allowable to set the number, arrangement, shape, pitch, etc., of the pressure chambers arbitrary or optionally, and according to this, it is allowable to adjust the number, arrangement, shape, pitch, etc., of the individual electrodes and the nozzles. Further, the inner diameter of the nozzle 45, the height of the wide part 43W, the height of the throttle part 43S, etc., in the above-described embodiment are described as examples only, and the present disclosure is not limited thereto or restricted thereby, and may be changed as appropriate. For example, in the above-described embodiment, the height H2 of the throttle part 43S is uniform in the longitudinal direction (the left-right direction) of the throttle part 43S. However, under a condition that any stepped part in the up-down direction at which the air bubble of the air might be caught is not provided in the inside of the throttle part 43S, it is not necessarily indispensable that the height H2 of the throttle part 43S is uniform in the longitudinal direction (the left-right direction) of the throttle part 43S. For example, as depicted in FIG. 5, a height H2 of a throttle part 143S may be gradually increased toward the downstream side (left side in FIG. 5) of the flow of the ink.

Figure 6:
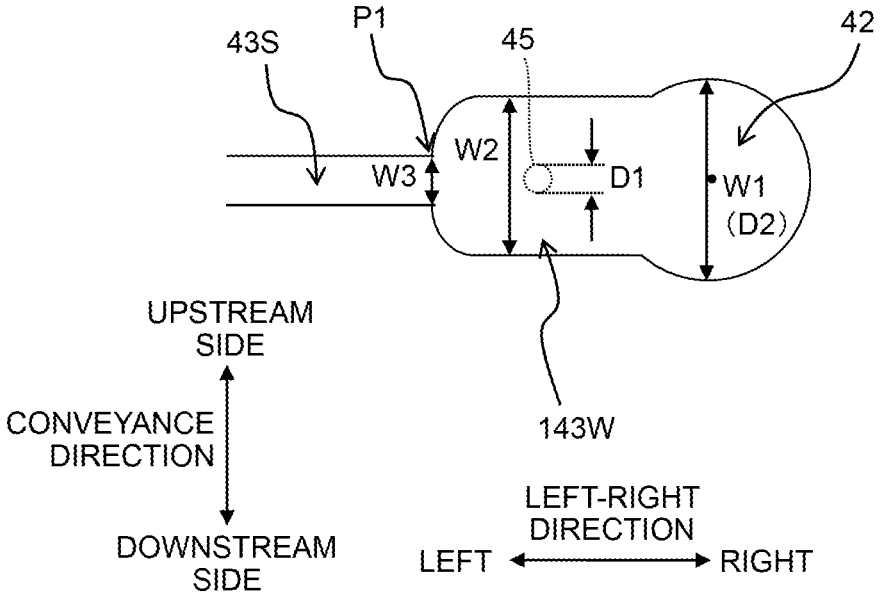
FIG. 6 is a view for explaining a wide part 143W, and corresponding to FIG. 4B.

In the above-described embodiment, the length W1 in the conveyance direction of the descender part 42 is same as the length W2 in the conveyance direction of the wide part 43W. However, the present disclosure is not limited to such an aspect. For example, as depicted in FIG. 6, a length W2 in the conveyance direction of a wide part 143W may be smaller than the length W1 in the conveyance direction of the descender part 42 (W2<W1). Also in this case, at the boundary between the descender part 42 and the wide part 143W, there is no stepped part (height in difference) in the conveyance direction and the left-right direction at which the air bubble of the air might be caught. Therefore, the air bubble of the air can be reliably pushed toward the return manifold 47. Note that the diameter D1 of the nozzle 45 is smaller than the length W2 in the conveyance direction of the wide part 143W (D1<W2). Since the diameter D1 of the nozzle 45 is smaller than the length W2 in the conveyance direction of the wide part 143W, the nozzle 45 can be arranged to ensure that the entirety of the nozzle 45 overlaps with the wide part 143W in the up-down direction. Thus, it is possible to reliably push the air bubble of the air entering from the nozzle 45 toward the return manifold 47.

Figure 7:
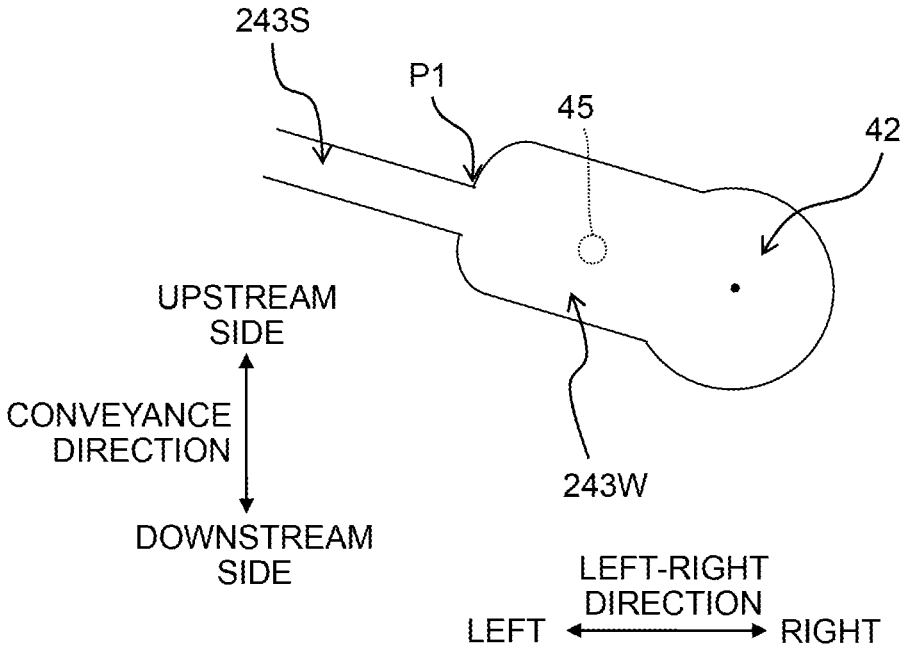
FIG. 7 is a view for explaining a wide part 243W and a throttle 243S, and corresponding to FIG. 4B.

In the above-described embodiment, the wide part 43W and the throttle part 43S extend parallel to the left-right direction, but the present disclosure is not limited to such an aspect. For example, as depicted in FIG. 7, a wide part 243W and a throttle part 243S may extend so as to be inclined toward one side (e.g., the upstream side) in the conveyance direction, rather than extending parallel to the left-right direction. In such a case, as compared to the case wherein the wide part 43W and the throttle part 43S extend parallel to the left-right direction, the sum total of the lengths in the extending direction of the wide part 243W and the throttle part 243S can be made longer. This makes it possible to increase the channel resistance in the returning part (the wide part 243W and the throttle part 243S) as compared with the case wherein the wide part 43W and the throttle part 43S extend parallel to the left-right direction. Therefore, it is possible to reduce such a situation that the pressure wave generated in the pressure chamber 40 escapes through the returning part. Further, in FIG. 7, the wide part 243W and the throttle 243S extend in a same directions. Therefore, there is no bent part or curve part at the boundary between the wide part 243W and the throttle 243S, and the air bubble of air is less likely to be caught. Note that in FIG. 7, both the wide part 243W and the throttle 243S extend so as to be inclined toward one side (e.g., the upstream side) in the conveyance direction with respect to the left-right direction, but the present disclosure is not limited to such an aspect. For example, one of the wide part 243W and the throttle 243S may extend so as to be inclined toward one side (e.g., the upstream side) in the conveyance direction with respect to the left-right direction. Also in this case, the channel resistance in the returning part (the wide part 243W and the throttle part 243S) can be made greater than in the case wherein the wide part 43W and the throttle part 43S extend parallel to the left-right direction.

Figure 8:
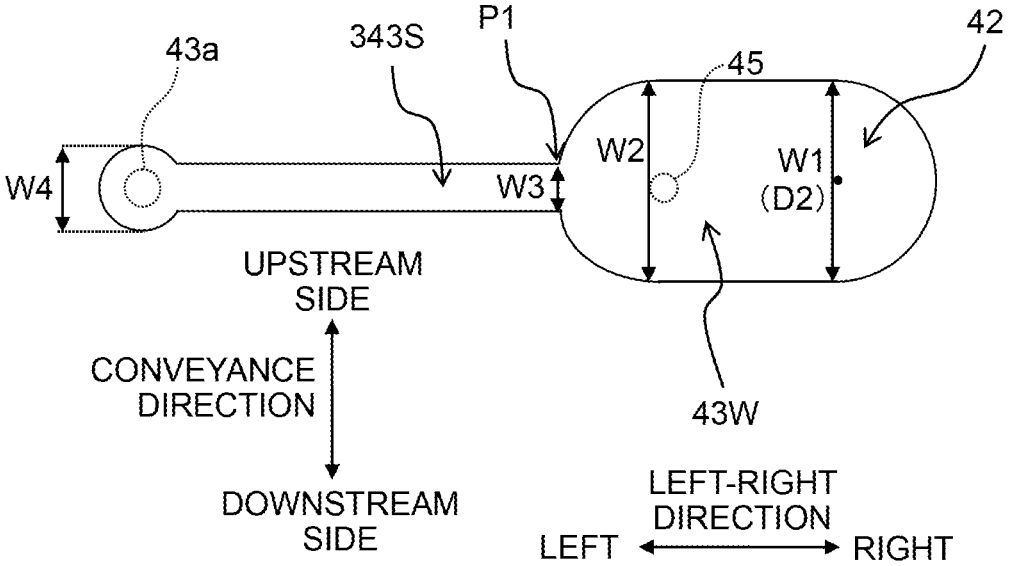
FIG. 8 is a view for explaining a wide part 343W, and corresponding to FIG. 4B.

In the above-described embodiment, the length in the conveyance direction of the throttle part 43S is uniform in the extending direction (left-right direction). However, the present disclosure is not limited to such an aspect. For example, as depicted in FIG. 8, a length W4 in the conveyance direction of an end part, in the left-right direction of a throttle 343S, on a side opposite to the throttle-stating position P1 may be greater than a length W3 in the conveyance direction of the throttle part 343S at the throttle-stating position P1 (W4>W3). In this case, in a case that the plate 110 and the plate 109 are positioned with respect to each other, it is easy to position the return port 43*a* formed in the plate 109 and the throttle part 343S formed in the plate 110 to each other. Note that the shape of the throttle part 343S is not limited to such an aspect; it is allowable, for example, that the throttle part 343S is formed to have such a shape in which the length in the conveyance direction of the throttle 343S becomes gradually longer toward the left side in the left-right direction. Further, note that the length W4 in the conveyance direction of the end part, of the throttle 343S, on the side opposite to the throttle starting position P1 in the left-right direction may be a length in a range of approximately 100 μm to approximately 130 μm.

The above-described embodiment and modifications are not limited to the above-described aspects, and may be combined as appropriate.

In the above-described embodiment, although the ink-jet head is the ink-jet head of the so-called line-type, the present disclosure is not limited to this; the present disclosure is applicable also to an ink-jet head of a so-called serial-type. Further, the present disclosure is not limited to being applicable to the ink-jet head which discharge an ink. The present disclosure is also applicable to a liquid discharge apparatus usable in a variety of kinds of usages or applications other than printing image, etc. For example, it is possible to apply the present disclosure also to a liquid discharge apparatus configured to form a conductive pattern on a surface of a substrate by discharging a conductive liquid onto the substrate.

What is claimed is:

1. A liquid discharge head comprising:

a first common channel extending in a first direction;

a second common channel extending in the first direction; and a plurality of individual channels including a plurality of pressure chambers arranged side by side in the first direction and a plurality of nozzles arranged side by side in the first direction, wherein each of the plurality of individual channels includes:

a supplying part which communicates the first common channel with one of the plurality of pressure chambers;

a descender part which extends in a second direction crossing the first direction and which communicates one of the plurality of pressure chambers located on an upstream side in the second direction with one of the plurality of nozzles located on a downstream side in the second direction; and a returning part which branches from the descender part, which extends in a third direction crossing the first direction and the second direction and which communicates with the second common channel, wherein the returning part of each of the plurality of individual channels includes:

a throttle part, a downstream end in the third direction of the throttle part being connected to the second common channel; and a wide part, an upstream end in the third direction of the wide part being connected to the descender part, a downstream end in the third direction of the wide part being connected to an upstream end in the third direction of the throttle part, and a cross-sectional area of a surface, of the wide part, which is perpendicular to the third direction is greater than a cross-sectional area of a surface, of the throttle part, which is perpendicular to the third direction;

wherein each of the plurality of nozzles is located at a position at which each of the plurality of nozzles overlaps with the wide part in the second direction, and wherein at a throttle-starting position which is a boundary between the throttle part and the wide part, a length in the second direction of the throttle part and a length in the second direction of the wide part are same.

2. The liquid discharge head according to claim 1, wherein an end part, of the wide part, on a side of the throttle part in the third direction has an elliptical shape.

3. The liquid discharge head according to claim 1, wherein $L2<L1$ is satisfied, provided that L1 is a distance in the third direction from a center of each of the plurality of nozzles to a center of the descender part, and L2 is a distance in the third direction from the center of each of the plurality of nozzles to the throttle-starting position.

4. The liquid discharge head according to claim 1, wherein $W1=W2$ is satisfied, provided that W1 is a length in the first direction of the descender part, and W2 is a length in the first direction of the wide part.

5. The liquid discharge head according to claim 1, wherein $D1<L3$ is satisfied, provided that L3 is a distance in the third direction from a boundary between the descender part and the wide part up to the throttle-starting position, and D1 is a diameter of each of the plurality of nozzles.

6. The liquid discharge head according to claim 1, wherein $D1<W2\leq W1$ is satisfied, provided that W1 is a length in the first direction of the descender part, W2 is a length in the first direction of the wide part, and D1 is a diameter of each of the plurality of nozzles.

7. The liquid discharge head according to claim 1, wherein the wide part extends in an oblique direction inclined relative to the third direction in a plane perpendicular to the second direction.

8. The liquid discharge head according to claim 7, wherein the throttle part extends in the oblique direction inclined with respect to the third direction in the plane perpendicular to the second direction.

9. The liquid discharge head according to claim 1, wherein $W3\leq(W2)/2$ is satisfied, provided that W2 is a length in the first direction of the wide part, and W3 is a length in the first direction of the throttle part at the throttle-starting position.

10. The liquid discharge head according to claim 1, wherein $W3<W4$ is satisfied, provided that W3 is a length in the first direction of the throttle part at the throttle-starting position and W4 is a length in the first direction of the downstream end in the third direction of the throttle part.

11. The liquid discharge head according to claim 1, wherein the descender part is a channel having a cylindrical shape and extending in the second direction, and wherein $L3<D2$ is satisfied, provided that D2 is a diameter of the descender part, and L3 is a distance in the third direction from a boundary between the descender part and the wide part up to the throttle-stating position.

* * * * *